US012590751B2

(12) United States Patent
Gerstmayr et al.

(10) Patent No.: US 12,590,751 B2
(45) Date of Patent: Mar. 31, 2026

(54) DOMESTIC APPLIANCE HAVING A SYMMETRICAL BRACKET OF A HINGE FOR A DOOR

(71) Applicant: BSH Hausgeräte GmbH, Munich (DE)

(72) Inventors: Florian Gerstmayr, Gundelfingen (DE); Johannes Köpf, Amstetten (DE); Alfred Raab, Hüttlingen (DE); Christian Schmid, Neu-Ulm (DE)

(73) Assignee: BSH Hausgeräte GmbH, Munich (DE)

( * ) Notice: Subject to any disclaimer, the term of this patent is extended or adjusted under 35 U.S.C. 154(b) by 269 days.

(21) Appl. No.: 18/251,417

(22) PCT Filed: Oct. 27, 2021

(86) PCT No.: PCT/EP2021/079758
§ 371 (c)(1),
(2) Date: May 2, 2023

(87) PCT Pub. No.: WO2022/096333
PCT Pub. Date: May 12, 2022

(65) Prior Publication Data

US 2023/0400243 A1 Dec. 14, 2023

(30) Foreign Application Priority Data

Nov. 5, 2020 (DE) ..... 10 2020 213 908.3

(51) Int. Cl.
*F25D 23/02* (2006.01)

(52) U.S. Cl.
CPC ..... *F25D 23/02* (2013.01); *F25D 2323/024* (2013.01)

(58) Field of Classification Search
CPC .. F25D 23/02; F25D 23/028; F25D 2323/024; F25D 2323/022;
(Continued)

(56) References Cited

U.S. PATENT DOCUMENTS 4,070,728 A * 1/1978 Herman ..... E05D 7/0415 16/DIG. 34
5,215,367 A * 6/1993 Montuoro ..... E05D 11/00 248/188.4
(Continued)

FOREIGN PATENT DOCUMENTS

CN 101086194 A 12/2007
CN 103836874 A 6/2014
(Continued)

*Primary Examiner* — Janet M Wilkens
(74) *Attorney, Agent, or Firm* — Laurence A. Greenberg; Werner H. Stemer; Ralph E. Locher

(57) ABSTRACT

A household appliance includes a housing, at least one hinge mounted on a front of the housing, and a door mounted on the hinge and thus mounted pivotably relative to the housing. The hinge has a bearing bracket fastened to an end face of the front with at least one fastening element. The bearing bracket is constructed symmetrically, so that it can be installed either on a left end face of the front or on a right end face of the front, and in both installation situations the door mounted on the bearing bracket is situated in the same position relative to the housing in the height direction and the width direction of the household appliance when in the closed state. A method for producing a household appliance is also provided.

10 Claims, 15 Drawing Sheets

(58) Field of Classification Search
CPC ..... F25D 2323/0011; F25D 2400/40; E05D 7/081; E05D 5/06; E05D 11/0081; E05Y 2900/31; E05Y 2600/626
USPC ..... 312/405, 326–329; 16/248, 240, 245, 16/246
See application file for complete search history.

(56) References Cited

U.S. PATENT DOCUMENTS

| | | | | |
|---|---|---|---|---|
| 5,788,351 | A * | 8/1998 | Prunty | A47L 15/4261 16/DIG. 34 |
| 5,941,619 | A * | 8/1999 | Stieben | F25D 23/028 312/405 |
| 9,074,809 | B2 * | 7/2015 | Lee | E05D 7/0423 |
| 9,140,045 | B1 | 9/2015 | Finkelstein et al. | |
| 2002/0092131 | A1 * | 7/2002 | Williamson | E05D 9/00 16/378 |
| 2009/0251039 | A1 * | 10/2009 | Muhlburger | E05D 7/04 312/405 |
| 2012/0181912 | A1 * | 7/2012 | Cui | E05D 7/0027 16/248 |
| 2014/0132141 | A1 * | 5/2014 | Sun | F25D 23/028 16/248 |
| 2014/0259529 | A1 * | 9/2014 | Jenkinson | E05D 7/0027 16/248 |
| 2017/0167173 | A1 * | 6/2017 | Johnson | E05D 5/06 |
| 2023/0114849 | A1 * | 4/2023 | Hunter | F25D 23/028 49/381 |

FOREIGN PATENT DOCUMENTS

| | | | |
|---|---|---|---|
| CN | 104285024 | A | 1/2015 |
| DE | 202004007067 | U1 | 7/2004 |
| DE | 20312282 | U1 | 1/2005 |
| DE | 102008021337 | A1 | 11/2009 |
| EP | 0927804 | A2 | 7/1999 |
| EP | 1679481 | A2 | 7/2006 |
| EP | 2735828 | A1 | 5/2014 |
| EP | 3037756 | A1 | 7/2016 |

* cited by examiner

DOMESTIC APPLIANCE HAVING A SYMMETRICAL BRACKET OF A HINGE FOR A DOOR

FIELD AND BACKGROUND OF THE INVENTION

One aspect of the invention relates to a household appliance having a housing. At least one receiving compartment for food is embodied in the housing. The household appliance has at least one hinge, which is arranged on a front of the housing. The household appliance also has a door, which is arranged on the hinge. As a result, the door is arranged pivotably relative to the housing. One aspect of the invention also relates to a method.

Household appliances are known for example as household refrigeration appliances. These usually have a housing with a door arranged pivotably thereon. A hinge is realized in order to enable this pivotability. Hinges of this kind have bearing brackets. In this connection, there are also embodiments in which these bearing brackets are arranged on the front side of the door. They are screwed to a front flange of the housing, for example. An embodiment of this kind is known for example from EP 1 679 481 A2. The bearing bracket there has an elongated, horizontal rail, which is used to fasten the bearing bracket directly to the front side of the housing. Furthermore, this bearing bracket has a bearing pin arranged asymmetrically relative to this rail when viewed in the width direction. The door is mounted on this bearing pin. The door can be mounted in only one hinging direction with a completely asymmetrical bearing bracket of this kind.

Furthermore, a hinge facility for a household refrigeration appliance is known from DE 10 203 12 282 U1. The hinge facility has a bearing block which can be screwed to a carcass of the household refrigeration appliance. This bearing block has a vertically oriented plate, with which the bearing block can be screwed to the carcass. Viewed in the width direction, this plate has two separate assembly openings, embodied at a distance from one another, through which the screws can be guided. Furthermore, this bearing block has two separate bearings, which are embodied next to one another in the width direction. A bearing pin which is embodied separately therefrom can be inserted and fastened into one of these bearings, in particular screwed therein. A bearing bushing can then be fitted rotatably on this bearing pin, which bearing bushing can in turn be fastened in the door. Both bearings are arranged offset relative to the assembly openings. This bearing bracket, too, can be installed and used only at a specific position of the housing.

In the known embodiments of the hinges, therefore, different embodiments are required which are assembled on the left side and on the right side on the housing in order to be able to assemble doors which can pivot differently in this regard. This increases the development outlay on the one hand and also the production and assembly outlay on the other hand.

SUMMARY OF THE INVENTION

The object of the present invention is to provide a household appliance in which a hinge is improved with regard to a usability and mounting of doors which are hinged in different manners.

This object is achieved by a household appliance and a method as claimed in the independent claims.

One aspect of the invention relates to a household appliance having a housing. At least one receiving compartment for food is embodied in the housing. The household appliance furthermore has at least one hinge. This hinge is arranged on a front of the housing. The household appliance furthermore has a door. This door is arranged on the hinge and as a result is arranged pivotably relative to the housing. The hinge has a bearing bracket, which is fastened to an end face of the front with at least one fastening element. The bearing bracket is designed symmetrically when viewed from the front side of the household appliance.

A symmetrical design means in particular that functionally essential features of the bearing bracket are arranged symmetrically relative to one another. The symmetry can be seen in particular in relation to a vertical axis of the bearing bracket. In particular, the vertical axis extends in the height direction of the household appliance. Functional features of the bearing bracket are in particular those relating to a support function and/or holding function for mounted parts on the bearing bracket which are separate from the bearing bracket and/or those relating to a connection function of the bearing bracket to another component of the household appliance. Such features are for example a bearing pin or a bearing journal for a door and/or at least one hole through which a fastening element, in particular a screw, can be guided so that the bearing bracket can be fastened on a component, in particular a housing, of the household appliance. In one exemplary embodiment, the bearing bracket is symmetrical only with regard to these features. It is then symmetrical only in a component-specific manner. With regard to other features, such as the shape of a support plate or a coupling plate and/or a contact plate etc., the bearing bracket can also be asymmetrical.

In one exemplary embodiment, however, the bearing bracket can also be symmetrical in this regard and is then completely symmetrical. Its symmetry is then not limited only to specific components.

As a result, the bearing bracket is embodied in accordance with its intended purpose such that it can be installed optionally on a left-side end face of the front or on a right-side end face of the front in the width direction when viewed from the front side of the household appliance. In both installation situations of the door on the bearing bracket, the door is thereby arranged in the same position on the housing in the closed state in the height direction of the household appliance and in the width direction of the household appliance.

On account of such a symmetrical bearing bracket, this can be used for both right-side and left-side installation on an end face of the front of the housing. Only one variant of a bearing bracket is thus required in order to be able to produce different variants of household appliances with regard to the opening side of the door. This one bearing bracket can thus be used both for household appliances in which the door is rotatable about a left-side vertical axis of rotation when viewed from the front side. This bearing bracket can however also be used for household appliances in which a door, when viewed from the front side, is to be pivotable about a right-side vertical axis of rotation. The bearing bracket is embodied symmetrically when viewed from the front side of the household appliance in the width direction. On account of this width symmetry, on the one hand the installation position of the bearing bracket on the left-side end face and in particular with regard to a left end of the housing can be embodied with the same distance as a corresponding right-side installation in which this bearing bracket then has an identical distance to a right-side end of the housing. As a result, the door is always arranged in the same height and width position on the housing, whether it is to be installed as a door which is left-hinged or right-hinged in accordance with the invention.

This applies in particular to the effect that receptacles on the front of the housing, which are provided to receive fastening elements, are embodied with the same distance with regard to their respective adjacent, left-side and right-side ends or walls of the housing. This means that for example for receptacles which are embodied as left-side screw holes for screws as fastening elements, a distance measured in the width direction relative to a left-side end of the housing is equal to the distance of fastening elements embodied accordingly on the right side, which are arranged or embodied adjacent to a right-side edge of the housing. If fastening element receptacles of this kind on the front of the housing are also embodied symmetrically relative to a center of the front of the housing, then a bearing bracket of this kind which is symmetrical in the width direction in this regard also makes it possible to achieve a symmetrical installation position of the bearing bracket relative to this center of the housing or the center of the front of the housing.

As a result, such a positioning of the door with hinging symmetry on the front of the housing is enabled in a particularly simple manner. As a result, an identical component of this kind in the form of the symmetrical bearing bracket also simplifies assembly. It is namely no longer necessary to pay attention to how the door is to be hinged and which bearing bracket required specifically for this purpose must then be used, but instead the same bearing bracket can always be used here.

In one exemplary embodiment, the bearing bracket is embodied symmetrically relative to an axis of symmetry oriented in the height direction of the household appliance.

In one exemplary embodiment, the bearing bracket has a contact plate, which rests directly on the end face of the front. In particular, the contact plate rests fully on this end face. This means that a maximum support of this contact plate on the end face is produced. A particularly stable fastening of the bearing bracket is thereby enabled.

In particular, the bearing bracket is arranged projecting forward from the end face in the depth direction of the household appliance. The bearing bracket thus does not extend backward over this end face but only forward. In particular, the contact plate is thus the component of the bearing bracket which is arranged the furthest to the back when viewed in the depth direction.

In one exemplary embodiment, in addition to the contact plate, the bearing bracket has a support plate which projects therefrom at an angle. This support plate is embodied to support a bearing pin which extends in the height direction. The bearing pin is likewise part of the bearing bracket.

In particular, the contact plate and this support plate form an L shape.

In one exemplary embodiment, when viewed in the width direction of the household appliance, the contact plate has at least two holes which are embodied spaced apart from one another and through which fastening elements are to be guided These fastening elements are in particular screws. In one exemplary embodiment, these two holes are embodied at the same height position on the contact plate when viewed in the height direction of the household appliance. A height offset can however also be embodied in this regard.

In particular, these holes are embodied symmetrically relative to a height axis of the bearing bracket, wherein this height axis is embodied centrally in the bearing bracket when viewed from the front side.

In particular, these holes are thus embodied symmetrically relative to a center of the contact plate.

The center is to be understood in the width direction in this regard.

In one exemplary embodiment, the bearing bracket has a bearing pin. The bearing pin is embodied in particular in one piece on the bearing bracket. "In one piece" is to be understood here and in the following to mean in particular formed from one piece, for example by means of casting, injection molding or reforming. The bearing pin preferably extends in the height direction. The bearing pin is arranged offset forward relative to the contact plate when viewed in the depth direction of the household appliance. The bearing pin is in particular integrated on the above-cited support plate. In particular, the bearing pin extends with its longitudinal axis, which is oriented in particular in the height direction of the household appliance, at right angles to the plane in which the support plate extends. The bearing pin, when viewed in the width direction of the household appliance and in a projection view or in the case of a projection into the contact plate from the front, is arranged such that it is arranged centrally relative to the contact plate, in particular relative to the complete bearing bracket. Insofar as holes are provided in the contact plate (for fastening the bearing bracket, for example), it can be provided in particular that, when viewed in the width direction of the household appliance and in a projection view or in the case of a projection into the contact plate from the front, the bearing pin is arranged such that it is arranged centrally between the holes in the contact plate. When viewed from the front side of the household appliance and thus also when viewed from the front side of the bearing bracket, these holes in the contact plate are thus embodied symmetrically relative to the bearing pin when viewed in the width direction. In particular, an axis of symmetry can be seen in this regard which extends in the height direction. This means that, in such a front-side projection view, a distance measured in the width direction between the axis of symmetry of the bearing pin and a hole is equal to the corresponding distance between the axis of symmetry and the other hole. In this connection, the bearing pin is arranged symmetrically relative to this axis of symmetry. This embodiment is particularly advantageous, since this symmetrical configuration between the bearing pin and the holes which are arranged laterally relative thereto in a front-side projection view makes the above-described installation particularly easily possible. On the one hand, the bearing bracket considered on its own is designed simply and symmetrically.

On the other hand, it can be assembled particularly easily and the door mounted accordingly thereon. It is however precisely this symmetrical relationship between the centrally positioned bearing pin and the holes embodied symmetrically relative thereto in the width direction which enables this installation of the bearing bracket with hinging symmetry on the end face of the front of the housing in a very simple manner. Precisely with the above-described embodiments of the receptacles for fastening elements on the end face of the front, this enables a highly symmetrical installation concept for a door.

In one exemplary embodiment, the bearing pin, when viewed in the width direction of the household appliance, is smaller than a smallest distance between the two holes measured in the width direction. This is a further very advantageous embodiment, since it enables fastening elements to be introduced into these holes and assembled easily without the bearing pin being in the way when viewed in the depth direction. In this way, it is easily possible to reach past the bearing pin with an assembly tool and insert and fasten the fastening element in the holes arranged therebehind. This is correspondingly advantageous in particular for screws, which must then be screwed in accordingly.

In a projection view, it is thus achieved that a bearing pin does not fully overlap with the holes in the width direction, in particular there is no overlapping at all.

In one exemplary embodiment, the bearing bracket, in particular the bearing pin, defines an axis of rotation of the door arranged thereon. In a front-side view of the household appliance, the axis of rotation is arranged centrally between the holes when viewed in the width direction with a projection into the contact plate. This, too, is a further advantageous exemplary embodiment, as it means that the angle is always formed such that an axis of rotation provided for the door is symmetrical relative to the holes. This, too, enables the corresponding installation of the bearing bracket with hinging symmetry on the left side or the right side on the end face of the front of the door, and for both positions then also an identical relative position of the door with respect to the housing.

In one exemplary embodiment, the bearing bracket has at least one, in particular integrated, positioning element. This positioning element projects further backward than the contact plate when viewed in the depth direction of the household appliance. In one exemplary embodiment, this positioning element projects into a receptacle or an insert in the end face of the front of the housing. In this way, a further mechanical coupling of the bearing bracket with the housing is achieved, in particular a form-fit coupling (for example a play-free form-fit coupling). In particular, this also improves or enables a torsional resistance of the bearing bracket about an axis oriented in the depth direction. The position fixing of the bearing bracket on the end face of the front of the housing is thereby once again improved. When viewed in the height direction, in one exemplary embodiment this positioning element is in a different height position than the holes in the contact plate. This, too, supports the fixed-position seating of the bearing bracket on the end face of the front. The insert can be formed by a receptacle or a bore, for example a blind bore.

In one exemplary embodiment, the hinge has a cable guiding apparatus. In accordance with the intended purpose, at least one cable of the household appliance is able to be laid or is laid through this cable guiding apparatus between the door and the housing. This is a further advantageous exemplary embodiment, since it means that components arranged in the door can also be supplied with energy and/or data signals and/or a control signal, where appropriate an analog control signal. In this way, it is achieved that the electronic components in the door can exchange signals and in this regard also communicate with components in the housing. The proposed concept is particularly advantageous precisely in the case of these kinds of embodiments of household appliances, since the cable guiding apparatus is thus installed in the hinge and in this regard also arranged therein in a space-saving and compact manner. An interface which is in any case present between the door and the housing and is formed by the hinge is thus used in a multifunctional manner.

In one exemplary embodiment, the bearing bracket has an integrated bearing pin. "Integrated" is to be understood here and in the following to mean that the two elements are embodied integrally, in other words in one piece, relative to one another. The hinge has a bushing which is separate from the bearing bracket. The bushing has in particular at least one insertion channel. This is provided in accordance with the intended purpose for inserting the bearing pin into the bushing. The bearing pin thus engages into this insertion channel in the installed state. A corresponding mechanical coupling is thereby also achieved.

In one exemplary embodiment, the insertion channel has an inner contour with a clamping structure. The clamping structure is provided in accordance with the intended purpose for holding in a clamping manner with the bearing pin. A highly effective mechanical coupling between the bushing and the bearing pin can thereby be achieved. In particular, a torsion-resistant coupling between the bushing and the bearing pin is thereby also achieved. A relative rotational movement between the bushing and the bearing pin in particular about the axis of rotation of the door is thus prevented.

In one exemplary embodiment, the clamping structure has at least one clamping pin, in particular two clamping pins, which interact in a clamping manner with the outside of the bearing pin.

In one exemplary embodiment, the bushing is a component of the cable guiding apparatus. The bushing then has a cable passage. This cable passage can be in particular a cable channel. In accordance with the intended purpose, this cable passage is thus embodied such that a cable can be guided therethrough. The cable is thus also arranged and guided in a particularly protective manner. Even when the door is pivoted relative to the bearing bracket, it is thus possible to avoid undesired mechanical influences on the cable. Kinks or a chafing on the cable during such a movement of the door can thus be prevented.

In one exemplary embodiment, the insertion channel of the bushing is separated from the cable passage of the bushing. This means that the channels provided in this regard are separate from one other. The cable is thus mounted in a different channel from the bearing pin which engages into the bushing. This, too, makes it possible to avoid undesired impairments of the cable. On the other hand, it also enables the bushing to be connected to the bearing pin in a mechanically stable manner. Coupling forces required for this purpose can be generated independently of the cable which is laid in the preferably different channel, namely the cable channel.

In one exemplary embodiment, the bushing is fastened in a torsion-resistant manner to the bearing pin which is separate therefrom.

In one exemplary embodiment, the bearing bracket is embodied in one piece, in particular from metal. It preferably has the contact plate, the support plate already mentioned, and the bearing pin.

In one exemplary embodiment, the bearing pin has a cuboid shape.

In one exemplary embodiment, the hinge has an adapter part which is separate from the bearing bracket. This adapter part is arranged in a torsion-resistant manner on a bearing pin of the bearing bracket. A preferably provided bushing of the hinge is arranged such that it sits on top of the adapter part which is separate therefrom when viewed in the height direction. In this exemplary embodiment, the parts which are separate from one another in the form of the bushing and the adapter part are thus arranged stacked on the bearing bracket which is in turn separate therefrom, in particular arranged stacked such that they sit on top of the bearing pin.

In one exemplary embodiment, the adapter part interacts with a spring, in particular a plastic spring of the household refrigeration appliance. The plastic spring is fastened to the door and, when the door is closed, slides over the adapter part which is fastened on the hinge. This generates a torque on the door, which closes the door above a certain opening angle or keeps it closed. In addition, in one exemplary embodiment a stopper is assembled on the door together with a plastic spring, which stopper strikes the adapter part and stops the door at a certain opening angle. As a result, the household refrigeration appliance also has a partially automatic closing function.

In one exemplary embodiment of the hinge without this adapter part, a bearing bracket without a closing function is realized. If the hinge has this additional adapter part, then a bearing bracket with a closing function is realized.

In a further exemplary embodiment, the bearing bracket has the already mentioned and horizontally oriented support plate or coupling plate. In one exemplary embodiment, a separate freestanding foot of the household appliance which is separate from the bearing bracket is arranged directly on, in particular fastened to, this coupling plate. This freestanding foot is in particular screwed onto the coupling plate. For this purpose, the coupling plate has a threaded hole into which the freestanding foot can be screwed with a threaded screw. This embodiment enables not only the fastening of the freestanding foot to the bearing bracket but also a height adjustment of the freestanding foot, wherein this can be set as a function of the extent to which the freestanding foot is screwed into the thread of the threaded hole.

In particular, it can be provided that the coupling plate has a first section at a first height level (H1) and a second section at a second height level (H2) which is different from the first height level (H1). Here, the height levels are measured in the height direction (y direction) of the household appliance. The first section and/or the second section is preferably embodied to be substantially or completely even (notwithstanding additional embossed areas to increase rigidity, for example) and/or preferably aligned horizontally. This embodiment does not just increase the stability of the bearing bracket. Rather, on account of the two sections arranged offset in the height direction, regions of the bearing bracket are created which advantageously enable different functions. In this way, it can be provided in particular that the first height level (H1) is greater than the second height level (H2) and the bearing pin is embodied on the first section or embodied adjacent to the first section and a threaded hole receiving the freestanding foot is embodied in the second section. This makes it possible for the threaded hole to be arranged deeper than the bearing pin (or the first section). In particular, it can be provided that the threaded hole lies completely underneath the first height level (H1). In this way, even if the freestanding foot is fully screwed in, a sufficient distance between an upper end of the threaded screw on the one hand and a lower end of the door on the other hand can be enabled. This prevents the threaded screw from colliding with the door. On the other hand, however, a sufficient adaptation of the appliance height via the freestanding foot can nevertheless be achieved. In one exemplary embodiment, the bearing bracket is embodied from metal. It can be in particular a sheet-metal bracket.

In one exemplary embodiment, the separate adapter part is arranged on the bearing pin in a torsion-resistant manner. For this purpose, the adapter part has a through-hole through which the bearing pin extends. In addition, the adapter part can also be screwed to the bearing bracket, in particular the coupling plate or the support plate. In one exemplary embodiment, the bushing, which can then also be referred to here as the closure bushing, is then fitted onto this adapter part. It, too, is then fitted on the bearing pin.

In one exemplary embodiment, the holes in the contact plate are arranged such that access to these holes is enabled even if the bushing is already assembled on the bearing pin and a tool such as a screwdriver can be used to insert screws into the holes of the contact plate. In particular, this can also thus take place when viewed in the depth direction of the household appliance and a corresponding assembly of the screws past the bushing in the depth direction can be enabled.

In particular in the variant without the adapter part, the hinge is structured such that the holes in the contact plate are accessible even if the door is already arranged on the hinge. Even then it is possible to access these holes and fit screws, which can then be screwed in accordingly using a tool.

The exemplary embodiments already mentioned above with at least one positioning element on the bearing bracket can also be realized such that several positioning elements are present. Because such a bearing bracket is produced by reforming and/or stamping, these positioning elements can also be produced in a cost-neutral manner. They can easily be produced additionally during this reforming and/or stamping process. In particular, no additional material is required for this purpose.

In another exemplary embodiment, however, the positioning elements can also be formed by separate pins, which are fixed in a non-detachable manner in the bearing bracket. A pressing into receiving holes in the contact plate can be provided here, for example.

In one exemplary embodiment, the coupling plate can have embossed areas. This increases the torsional rigidity.

In one exemplary embodiment, the adapter part has a notch which is open on the edge side. This makes it possible to guide the cable easily past the adapter part. In this exemplary embodiment, the cable then does not have to be guided through a circumferentially closed hole.

In this exemplary embodiment, the cable passage in the bushing is embodied to have a cross-section which is not circular but instead oval.

When viewed in the height direction, the upper end and/or the lower end of this cable passage can be rounded. As a result, sharp edges or corners can be avoided. Impairments of the cable are thereby avoided. In one exemplary embodiment, the adapter part is embodied to be installed with hinging symmetry on the bearing bracket. If the door hinging is changed, it can therefore be removed from the bearing bracket, rotated by 180°, and re-installed on the bearing bracket.

In one exemplary embodiment, the contact plate projects from the coupling plate or the support plate in the same direction as the bearing pin when viewed in the height direction. A U shape of the bearing bracket is thus formed in this regard. The fact that the bearing pin and the contact plate effectively project in the same direction from the coupling plate or the support plate also means that the height of the bearing bracket is reduced in comparison to exemplary embodiments in which the bearing pin projects from the coupling plate in the positive height direction and the contact plate projects from the coupling plate in the negative height direction.

As a result of the embodiment of the hinge, an improvement with regard to an automatic fastening, for example adhesive bonding, of the base, in particular of a base board of the housing of the household appliance, is also achieved. This is because there is no longer any need for space for the hinge screwed from below on the appliance base. A fastening and screwed connection of the bearing bracket takes place exclusively from the front, or the screwed connection is provided exclusively on the end face of the front. Furthermore, on account of the installation position of the freestanding foot of the household appliance being no longer directly on the housing but instead on this angle bracket, it is also achieved that it is no longer necessary to engage below the housing when assembling this freestanding foot. The installation position of the freestanding foot is thus shifted forward when viewed in the depth direction. This avoids damaging the base of the housing, especially if it is made from cardboard. The door, too, is thus protected in an improved manner against damage caused by the adjusting support or the freestanding foot during the assembly thereof. The possibility that the appliance could tip over during installation of the freestanding foot is also reduced.

The advantageous exemplary embodiment with the cable guide in the hinge now also makes it easily possible to install electronic components, an operating and/or display unit and/or a camera or the like in the door. In the advantageous exemplary embodiments cited, this cable only has to be threaded through the advantageously embodied bushing; it no longer needs to be guided circumferentially through other components of the hinge.

Furthermore, as a result of the exemplary embodiments cited, a standard system is also created as the hinge, which can be used both for household appliances with such a cable and also those without such a cable. Likewise, this is enabled both for appliances with a closure in the region of the hinge and also those without such a closure in the region of the hinge.

A further aspect of the invention relates to a method for producing a household appliance, in which the following steps are carried out:

- providing a housing of the household appliance, wherein at least one receiving space for food is embodied in the housing,
- providing at least one symmetrical bearing bracket of a hinge of the household appliance, wherein the hinge is embodied in accordance with the intended purpose to receive a door of the household appliance so that the door can be pivoted relative to the housing in the assembled state,
- optionally producing a variant of the household appliance with regard to the side on which the door is hinged, by the symmetrical bearing bracket being installed optionally on a left-side end face of a front of the housing or on a right-side end face of the front of the housing and, in particular on account of the symmetrical construction of the bearing bracket, the door arranged on the symmetrical bearing bracket is arranged automatically in the same position relative to the housing in both possible installation situations in the closed state in the height direction and in the width direction of the household appliance.

With this method, an identical bearing bracket enables the door to be installed on two different sides of the front and nevertheless then be positioned identically relative to the housing. A simple creation of variants of household appliances in relation to how the door is hinged in each case is thereby enabled.

Advantageous exemplary embodiments of the household appliance are to be regarded as advantageous exemplary embodiments of the method. Here, the elements forming the subject matter and/or the specified positions of elements enable the specific method steps either on their own or in interaction with one another.

The designations "above", "below", "in front", "behind", "horizontal", "vertical", "depth direction", "width direction", "height direction", etc. indicate positions and orientations during proper use and arrangement of the door or the appliance.

Further features of the invention are apparent in the claims, the figures and the description of the figures. The features and combinations of features mentioned in the description above and the following features and combinations of features in the description of the figures and/or shown in the figures alone are usable not only in the respective combination given but also in other combinations without departing from the scope of the invention. Embodiments of the invention that are not illustrated specifically in the figures and described but emerge and can be generated as a result of separate feature combinations from the described embodiments should therefore also be considered to be comprehensive and disclosed. Embodiments and combinations of features can also be regarded as disclosed which therefore do not have all the features of an originally formulated independent claim. Furthermore, embodiments and combinations of features are to be regarded as disclosed, in particular by the embodiments disclosed above, which go beyond or deviate from the combinations of features represented by the references in the claims.

Exemplary embodiments of the invention will now be described in greater detail making reference to schematic drawings.

DETAILED DESCRIPTION OF THE INVENTION

Figure 1:
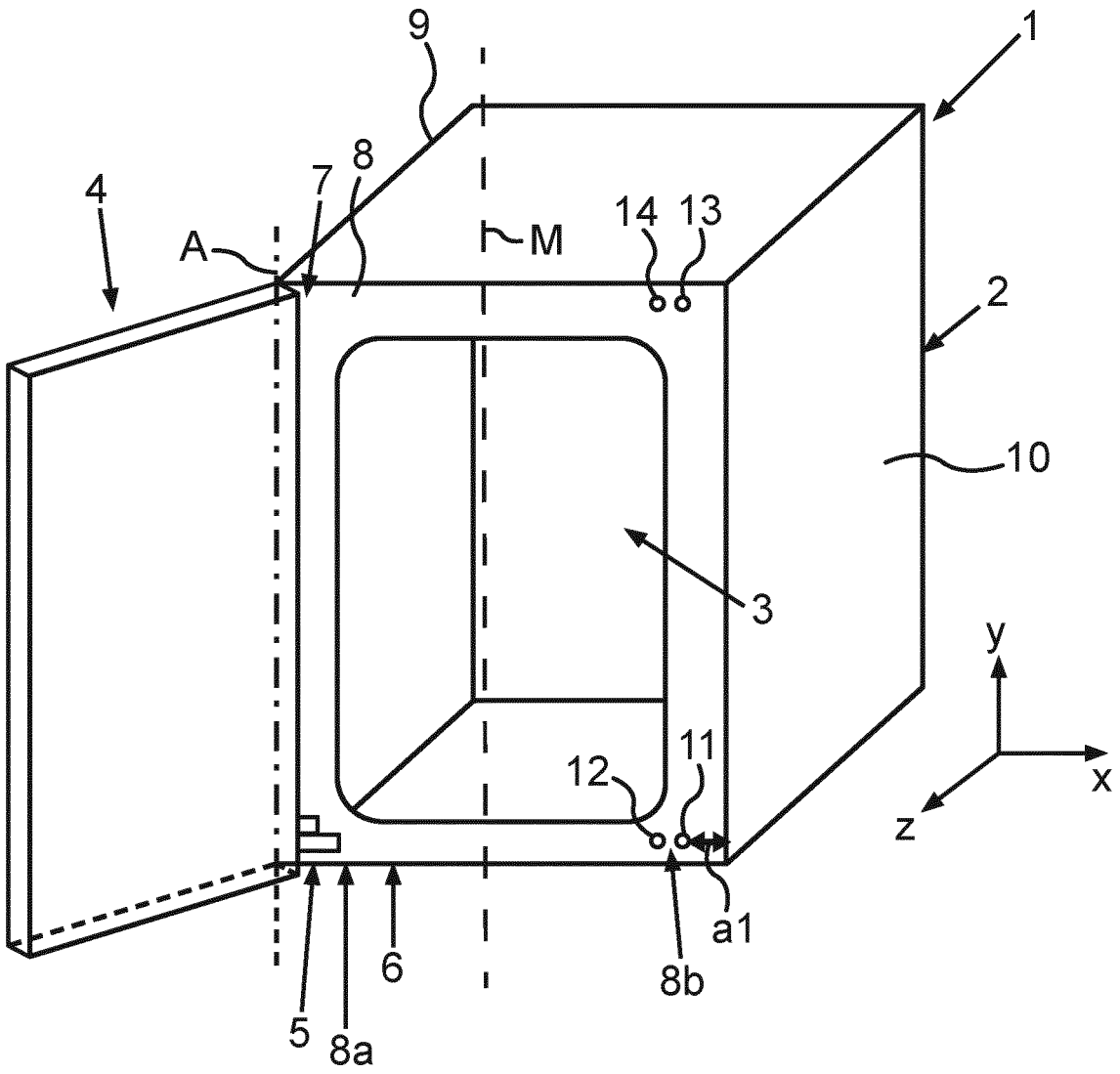
FIG. 1 shows a schematic representation of an exemplary embodiment of a household appliance according to the invention with an open door.

In the figures, identical or functionally identical elements are provided with the same reference characters.

FIG. 1 shows a schematic representation of a household appliance 1. The household appliance 1 can be for example a cooking appliance, such as a microwave cooking appliance or a steam cooking appliance or an oven. The household appliance 1 can however also be for example a bottle storage cabinet, such as for example a wine storage cabinet.

In particular, in one exemplary embodiment the household appliance 1 is a household refrigeration appliance. It is then embodied for storing and conserving foodstuffs. In this connection, it can be for example a refrigerator or a freezer or a combined refrigerator-freezer.

The household appliance 1 has a housing 2. At least one receiving compartment 3 for food is embodied in the housing 2. In this connection, the food can be edible or drinkable food.

The receiving compartment 3 is provided in accordance with the intended purpose to be filled with food.

The household appliance 1 furthermore has a door 4. The door 4 is arranged in a movable manner on the housing 2. The door 4 is provided to close the receiving compartment 3.

The household appliance 1 has a hinge 5. The hinge 5 is arranged on a front 6 of the housing 2. In the exemplary embodiment, the door 4 is arranged in the housing 2 by way of a further hinge 7. The hinges 5 and 7 enable the door 4 to be pivotable relative to the housing 2 about a vertical axis A, which is oriented in the height direction (y direction) of the household appliance 1. The door 4 is arranged directly on the hinges 5 and 7.

The front 6 has an end face 8. The hinges 5 and 7 are fastened directly to this end face 8. The hinges 5 and 7 are thus fastened exclusively to the front side of the housing 2.

When viewed in the width direction (x direction), the housing 2 has two opposite ends 9 and 10, here in the form of side walls. In one exemplary embodiment, these opposite ends 9 and 10 are formed by vertical side walls. These opposite ends 9 and 10 are in particular the lateral delimitations of the housing 2.

The hinges 5 and 7 are fastened detachably to this front 6 of the housing 2. In particular, they are screwed thereto.

Viewed generally, at least one hinge 5, 7 is embodied in accordance with the intended purpose to be installed with hinging symmetry on the front 6. This means that such a hinge 5 can be assembled in accordance with the intended purpose on the front 6 in a front-side view and thus with a view onto the loading opening of the receiving compartment 3 with the door 4 open and onto the door 4 with the door closed on the left side and thus adjacent to the first end 9 of the housing 2 or also on the right side and thus adjacent to the opposite end 10 of the housing 2. In the exemplary embodiment shown in FIG. 1, the door 4 is left-hinged in this front-side view. This means that the hinges 5 and 7 are arranged on the left side and are thus arranged adjacent to the first end 9 on the front 6. This hinge 5, 7 can thus be installed in accordance with the intended purpose optionally on a left-side end face 8*a* or on a right-side end face 8*b* of the front 6. In both installation situations, the door 4 which is then fastened thereto is arranged in the same position on the housing 2 in the closed state in the height direction and in the width direction of the household appliance 1.

FIG. 1 shows a schematic diagram of a first receptacle 11 and a second receptacle 12. The receptacles 11 and 12 are in particular screw receptacles for screws which represent fastening elements. These receptacles 11 and 12 are embodied here on the right-side end face 8*b*. Accordingly, in a further exemplary embodiment, two such receptacles can be also embodied accordingly on the right side. These cannot be seen in FIG. 1 as the hinge 5 is fastened thereto.

As can also be seen in FIG. 1, a corresponding embodiment with receptacles 13 and 14 is also realized in the upper region. The same applies to the arrangement shown in the region of the hinge 7.

In one exemplary embodiment, it is provided that a distance a1 measured in the width direction (x direction) between the receptacle 11 and the adjacent end 10 is in particular exactly as great as a corresponding distance of a receptacle on the hinge 5. This means that, on the left-side end face 8*a* in one exemplary embodiment, two such receptacles 11, 12 are likewise provided, to which the hinge 5 is fastened. There, too, a distance measured in this width direction between the outer receptacle 11 and the adjacent first end 9 then corresponds to the distance a1.

In one exemplary embodiment, this also applies to such a horizontal distance between the receptacle 12 lying further inward and the adjacent second end 10 and, in comparison thereto, to a receptacle 12 lying further inward embodied at the corresponding distance for the hinge 5 in FIG. 1 in relation to the end 9.

It can be provided that a first variant of the household appliance 1 is provided in which the door 4, when viewed from the front side, is hinged and assembled on the left side, as is already shown in FIG. 1 with the door 4. In this exemplary embodiment, the receptacles 11, 12, 13 and 14, which are shown on the right-side end face 8*b*, may not be present. It is however also possible, in one exemplary embodiment of a household appliance 1, for both the receptacles 11 to 14 on the right-side end face 8*b* and also the further receptacles 11 to 14 embodied with mirror symmetry relative to a center axis M to be embodied on the left-side end face 8*a*.

In a further exemplary embodiment of a variant of the household appliance 1, it can be provided that only the receptacles 11 to 14 shown on the right side in FIG. 1 are present on the right-side end face 8*b* and the corresponding left-side receptacles 11 to 14 on the left-side end face 8*a* are not present. In such an exemplary embodiment, the door 4 can then only be hinged on the right side and then pivoted about an axis of rotation A embodied on the right side.

In all three possible exemplary embodiments of a household appliance 1 with regard to the individual design of the receptacles 11 to 14, an identical hinge 5, 7 described in the following can be used as an identical component.

Figure 2:
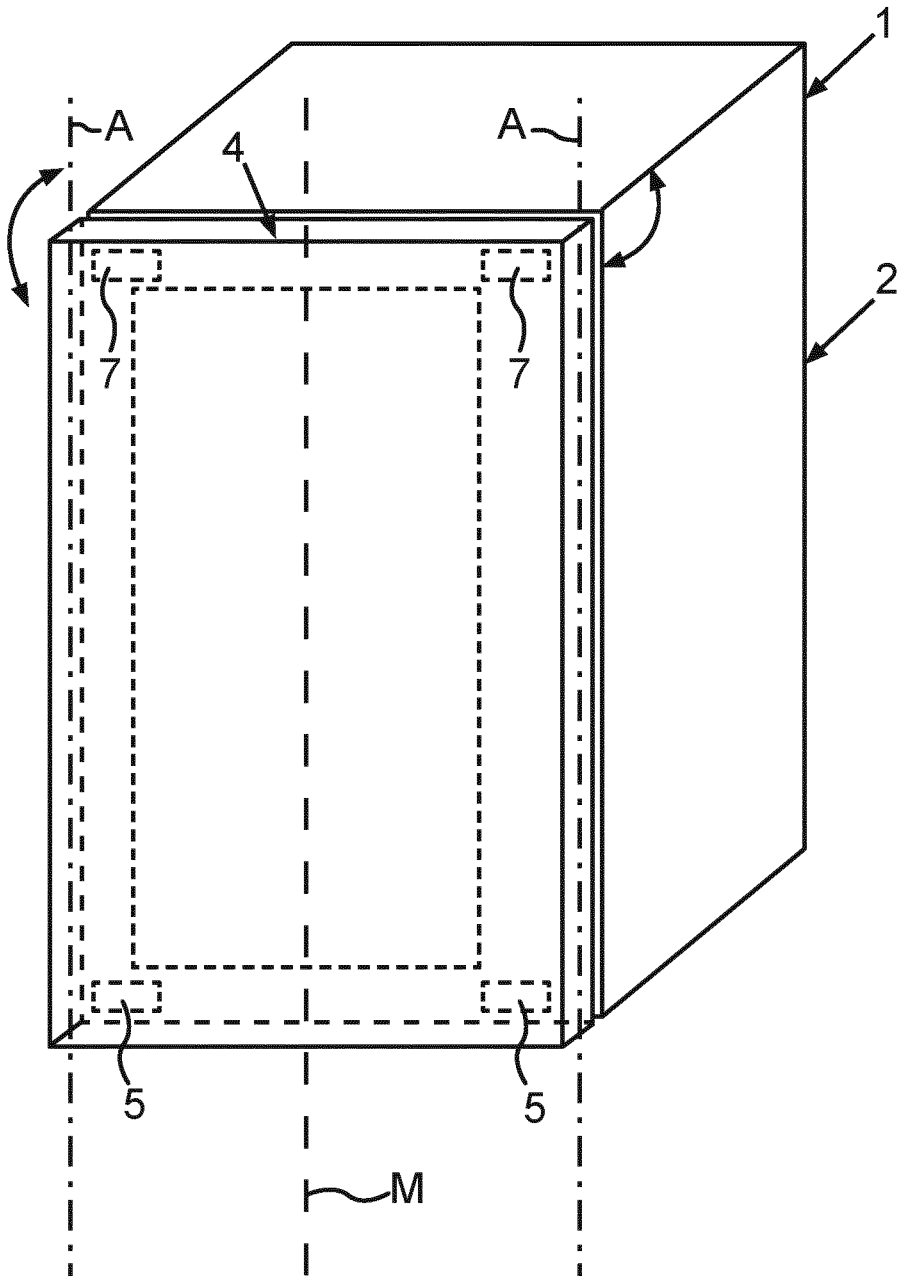
FIG. 2 shows a perspective-schematic representation of household appliance variants with regard to a door which is hinged on the left side and a door which is hinged on the right side, as can be realized on account of the symmetrical bearing bracket of the household appliance.

FIG. 2 shows a perspective representation of the household appliance 1 with a closed door 4. The possible installation variants of the door 4 are indicated here by way of example, which door, when viewed from the front side, can be pivoted about a left-side, vertical axis of rotation A or, if the hinges 5, 7, in particular the bearing bracket, are assembled with hinging symmetry, pivoted about a right-side, vertical axis of rotation A. The respective pivotability is also indicated by the arrows shown symbolically.

In the interest of clarity, FIG. 2 here shows by way of example the respective position of the lower hinge 5 of this installation option with hinging symmetry. Irrespective of whether this hinge 5 is installed on the left side or on the right side, in one exemplary embodiment the distance to the first end 9 or to the second end 10 when viewed in the width direction is identical. As shown in FIG. 2, the door 4 in the closed state thus has the same position on the housing 2 in both installation variants.

Here, the center M also represents an axis of symmetry oriented in the height direction, which is embodied centrally and on which the hinges 5 can be assembled with hinging symmetry, depending on whether a left-hinged door 4 or a right-hinged door 4 is to be realized.

Figure 3:
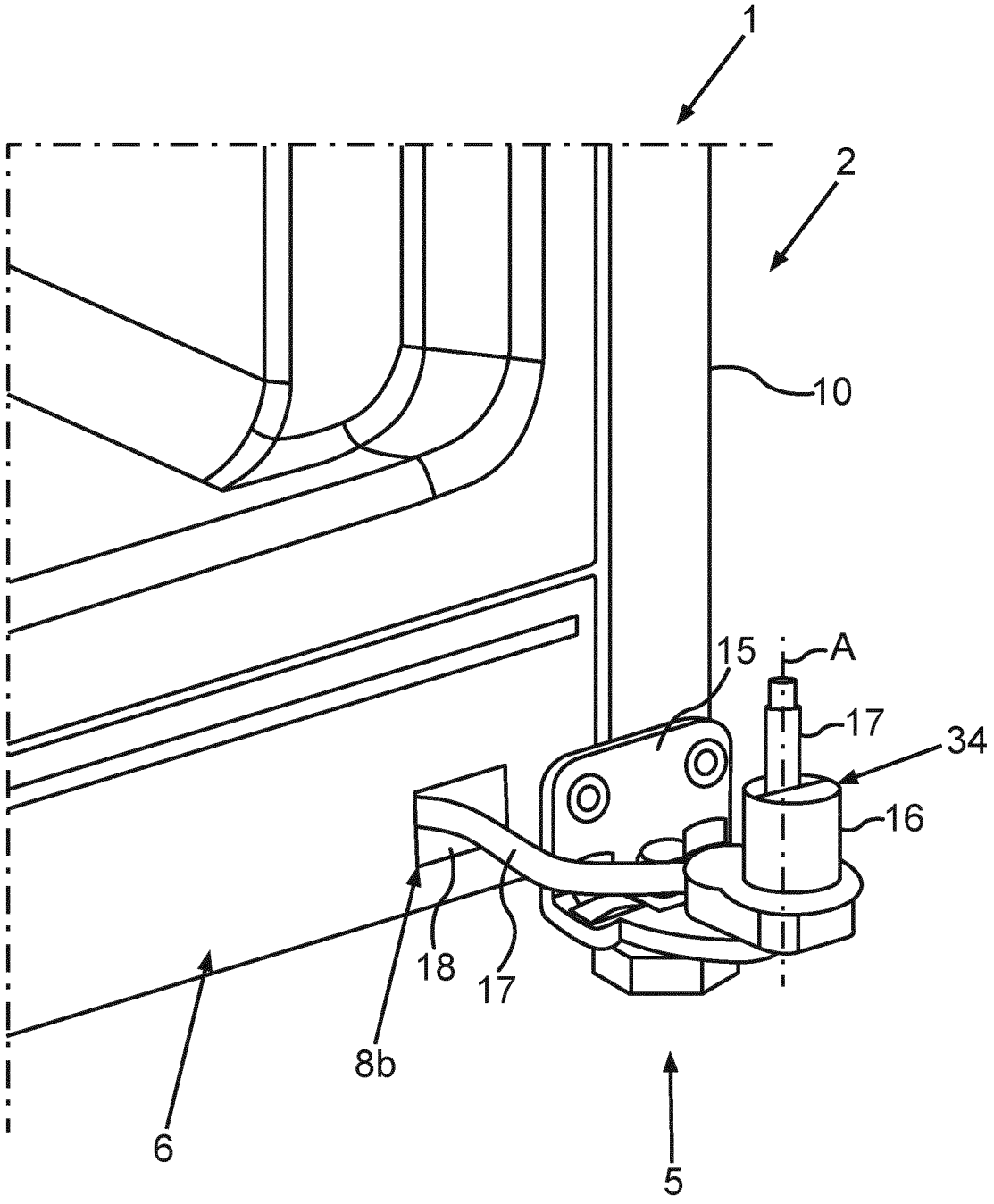
FIG. 3 shows a perspective representation of a subregion of a household appliance with an assembled hinge.

FIG. 3 shows a partial section of the household appliance 1 in a perspective representation. A right lower partial region of the housing 2 is shown here in a front-side view. In the example shown here, the hinge 5 is installed on the front of the right-side end face 8*b*.

It is shown here in the assembled state. The hinge 5 has a bearing bracket 15. The bearing bracket 15 is embodied in one piece. It is embodied in particular from metal. It can be for example a sheet-metal bracket. Furthermore, the hinge has a bushing 16. The bushing 16 is a component of the hinge 5 which is separate from the bearing bracket 15. The bushing 16 is fitted onto a bearing pin (not yet apparent) of the bearing bracket 15. Furthermore, a cable 17 is shown. The cable 17 of the household appliance 1 is laid in the region of the hinge 5 on this hinge 5. The cable 17 ends on the one side in the door 4 and on the other side in the housing 2.

Figure 4:
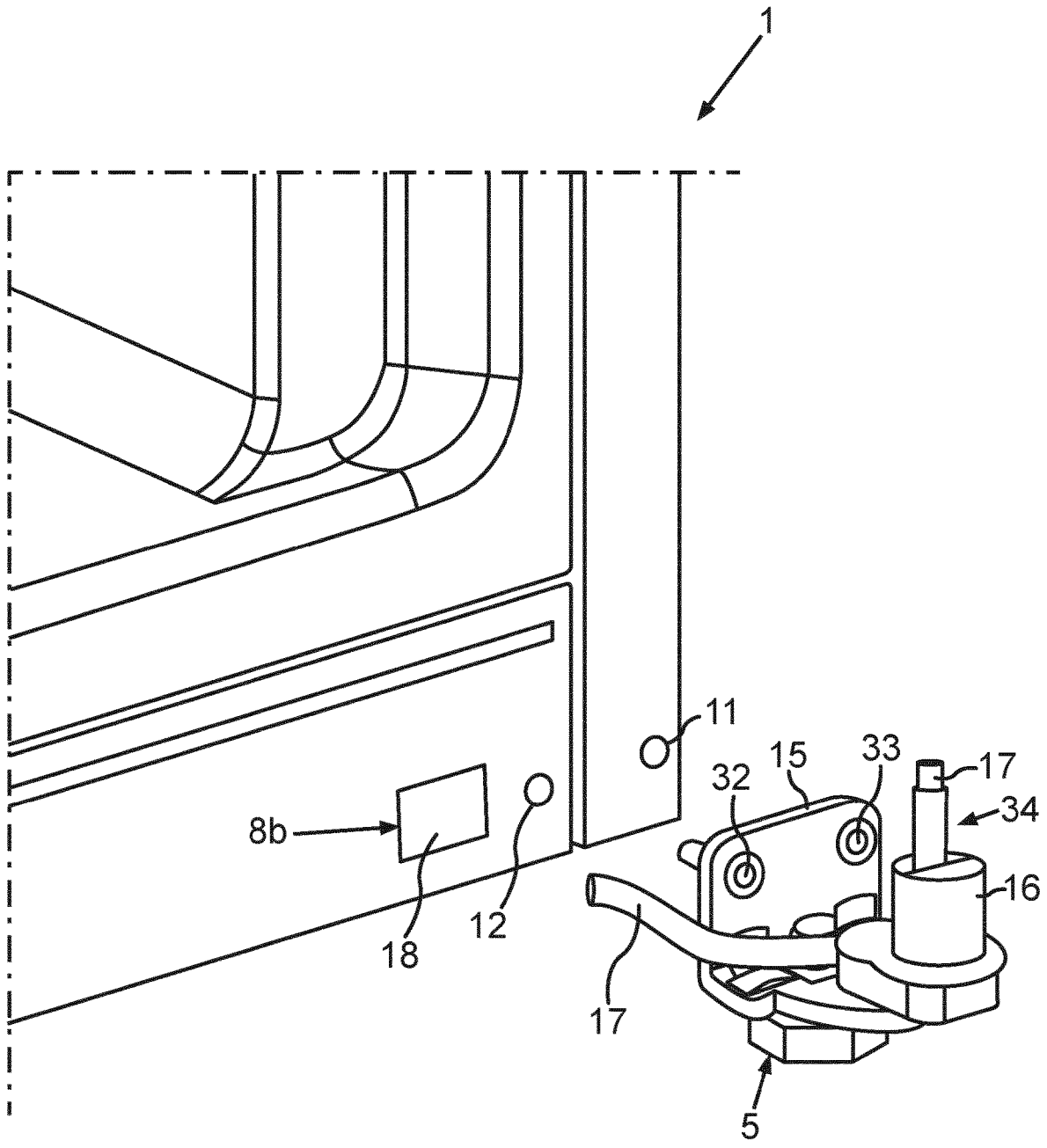
FIG. 4 shows the representation according to FIG. 3 with the hinge removed.

FIG. 4 shows the arrangement in accordance with FIG. 3, wherein the hinge 5 is however shown in the disassembled state. As a result, the receptacles 11 and 12 on the right-side end face 8*b* are apparent.

Furthermore, an opening 18 is also shown via which the cable 17 is laid into the housing.

Figure 5:
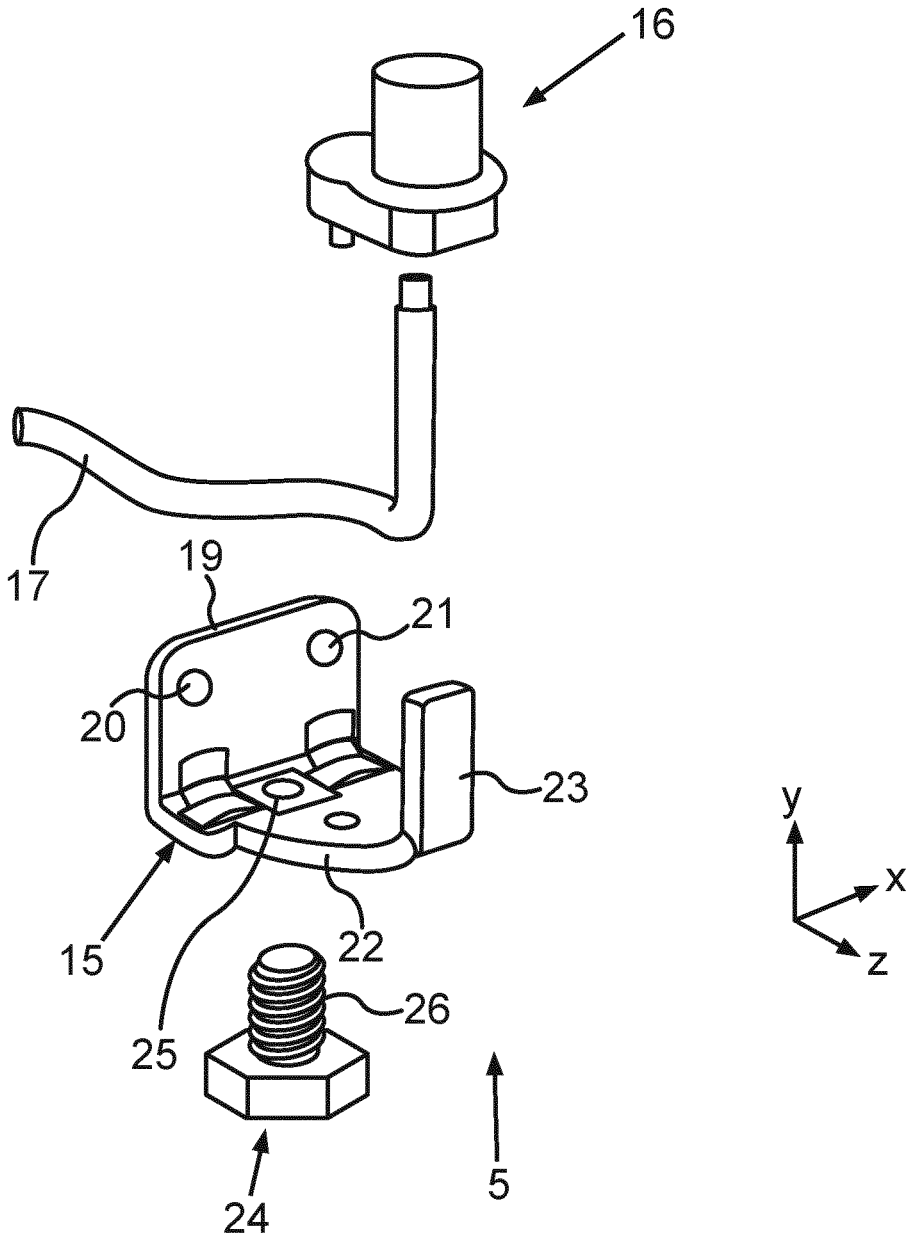
FIG. 5 shows an exploded representation of an exemplary embodiment of a hinge for an exemplary embodiment of a household appliance.

As is apparent in FIG. 5, the hinge has several separate parts in its exploded representation shown. This is on the one hand the bearing bracket 15. This bearing bracket 15 is U-shaped in the exemplary embodiment. It has a contact plate 19. This is provided in accordance with the intended purpose for direct contact on the end face 8*a*, 8*b*. The contact plate 19 has a first hole 20 when viewed in the width direction and at least one opposite second hole 21. The two holes 20 and 21 are provided so that fastening elements, in particular screws, can be guided through them. In this way, the bearing bracket 15 and thus the entire hinge 5 can be screwed onto the front 6. In the exemplary embodiment, the two holes 20 and 21 are embodied at the same height position when viewed in the height direction.

The bearing bracket 15 also has a support plate or a coupling plate 22. This extends horizontally. It is arranged at an angle, in particular 90°, to the contact plate 19. The bearing bracket 15 also has a bearing pin 23. The bearing pin 23 is embodied at a distance forward of the contact plate 19 in the depth direction (z direction). It extends away from the coupling plate 22 in the same direction as the contact plate 19.

FIG. 5 also shows a freestanding foot 24. The freestanding foot 24 is embodied separately from the bearing bracket 15. With the freestanding foot 24, the household appliance 1 stands directly on the floor. The freestanding foot 24 is provided to be fastened directly to the bearing bracket 15. In particular, the coupling plate 22 has a screw receptacle 25 for this purpose. The freestanding foot 24 can be screwed therein with a threaded pin 26 and set with its height adjusted.

Figure 6:
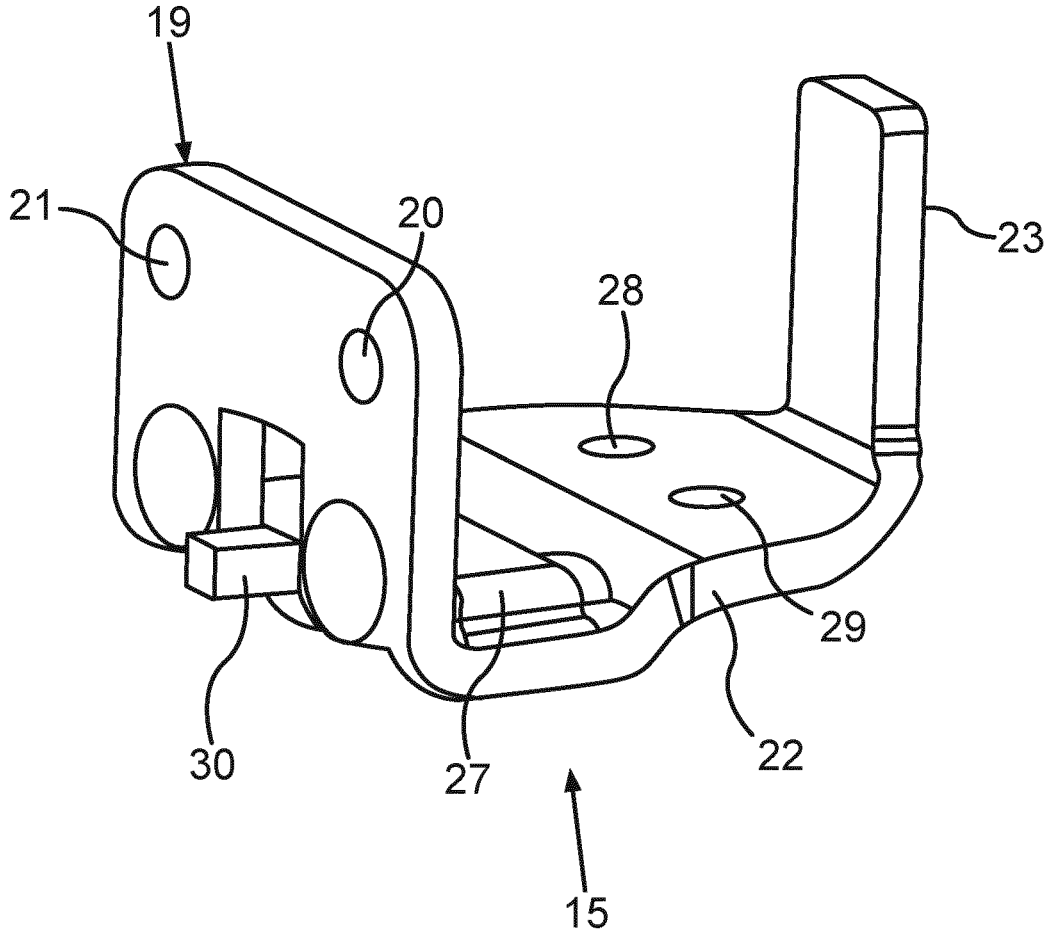
FIG. 6 shows a perspective representation of an exemplary embodiment of a bearing bracket of the hinge according to FIG. 5.

FIG. 6 shows a perspective representation of an exemplary embodiment of a bearing bracket 15. It is apparent that the bearing pin 23 has an angular, in particular rectangular, cross-section in one exemplary embodiment. The coupling plate 22 has embossed areas 27. As a result, it is more rigid. The coupling plate 22 can also have screw holes 28 and/or 29. An adapter part (not yet shown here), which can be a component of an exemplary embodiment of a hinge 5, 7, can be screwed to the screw hole 28 or to the screw hole 29, depending on its installation position on the bearing bracket 15.

As can also be seen in FIG. 6, the bearing bracket 15 has a positioning element 30 in the exemplary embodiment shown. The positioning element 30 extends further backward than the contact plate 19 in the depth direction (z direction). With this positioning element 30, which can engage into a receptacle in the end face 8*a* or 8*b*, the securely positioned assembly of the bearing bracket 15 on the front 6 can be improved. In particular, a torsional resistance can be increased thereby. To this end, the positioning element 30 is merely inserted into the receptacle.

More than one positioning element 30 can also be present. Reference may be made to the exemplary embodiment in FIG. 7 in this regard.

Here, two positioning elements 30 and 31 are provided.

In the exemplary embodiment in FIG. 6, the positioning element 30 can be produced by being punched out and bent round from the sheet-metal material of the bearing bracket 15 itself.

Figure 7:
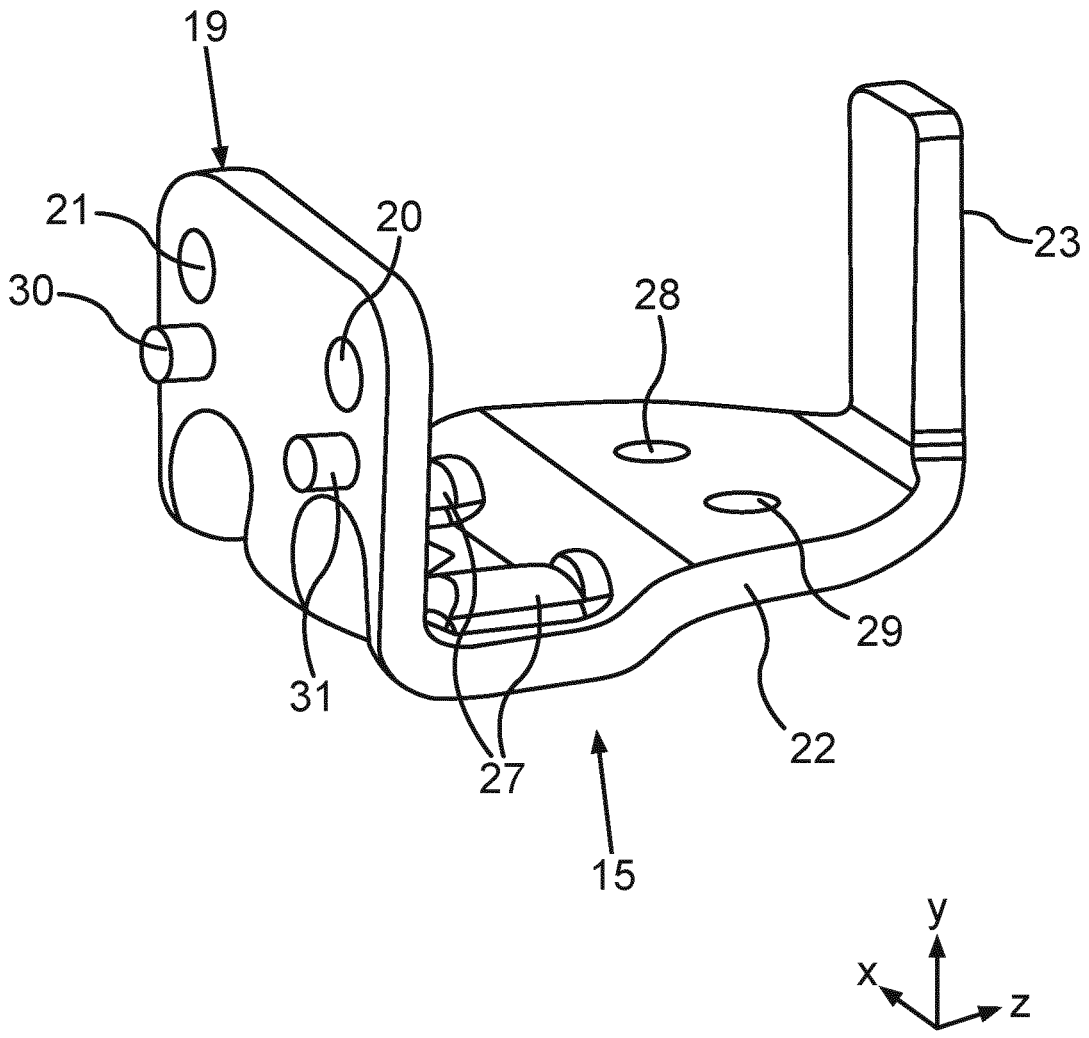
FIG. 7 shows a perspective representation of an alternative exemplary embodiment of a bearing bracket for a hinge according to FIG. 5.

In the exemplary embodiment in FIG. 7, the positioning elements 30 and 31 there are separate pins, which are pressed into the bearing bracket 15, in particular the contact plate 19.

In the exemplary embodiments shown, the positioning elements 30 or 30 and 31 are embodied below the holes 20 and 21 when viewed in the height direction.

Figure 8:
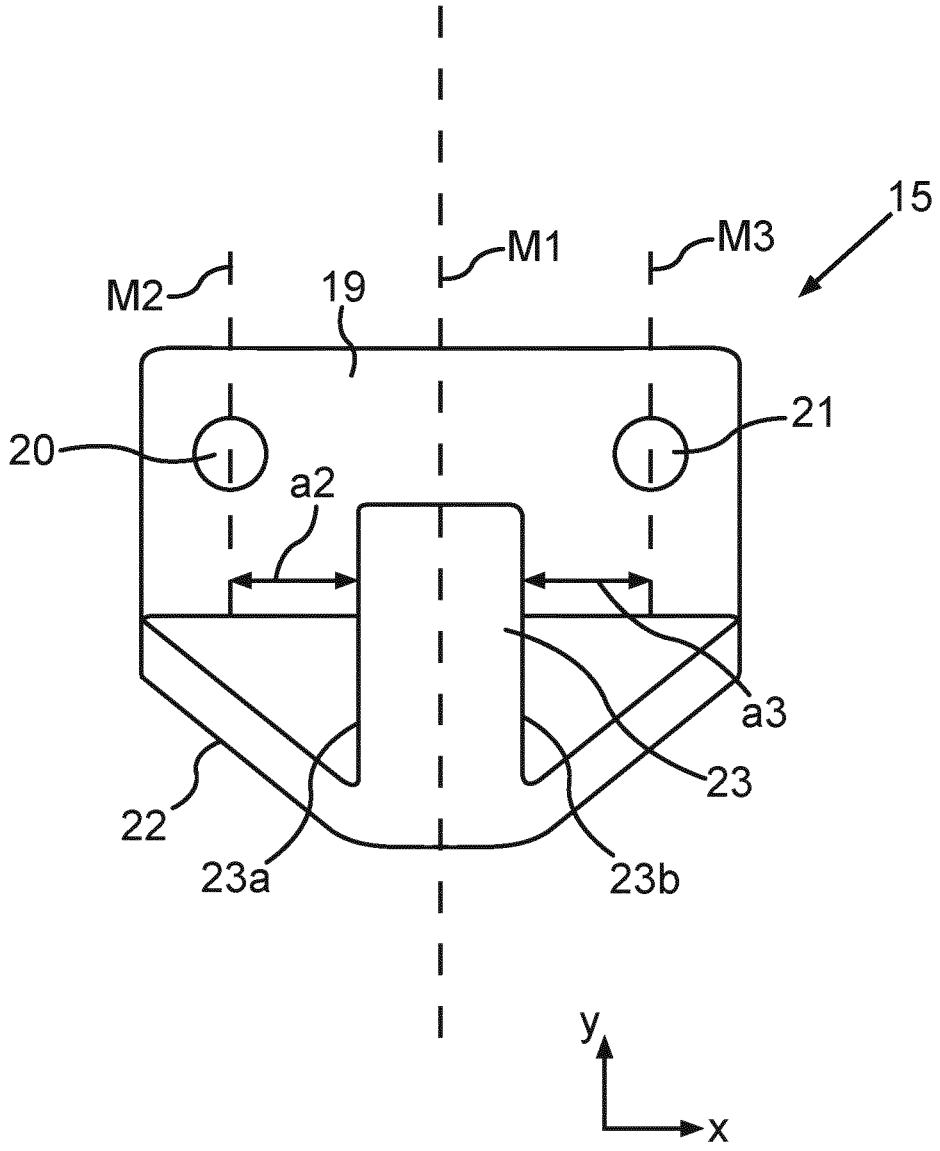
FIG. 8 shows a schematic front view of an exemplary embodiment of a bearing bracket which is embodied symmetrically.

FIG. 8 shows a schematic representation of a bearing bracket 15 viewed from the front (viewed in the negative z direction). In a projection view, in which the projection plane is the y-x plane, the bearing pin 23 is embodied centrally between the holes 20 and 21. In this context, the bearing pin 15 has an axis of symmetry M1 oriented in the height direction. In this context, the holes 20 and 21 are embodied in particular with mirror symmetry relative to this axis of symmetry M1. The bearing pin 23 lies on this axis of symmetry M1 and is likewise embodied symmetrically relative to this axis M1. This also means that, in this projection plane, center axes M2 and M3 of the holes 20 and 21 have the same distance to the axis of symmetry M1 when viewed in the width direction. It is furthermore provided that, in this projection plane, a distance a2 is equal to a distance a3. In this projection plane, the distance a2 designates a distance measured in the width direction between a left-side defining edge 23*a* of the bearing pin 23 relative to the center axis M2. In this projection plane, the distance a3 designates a distance likewise measured horizontally between a right-side side edge 23*b* of the bearing pin 23 relative to this center axis M3 of the hole 21. On account of this symmetry of the bearing bracket 15, in accordance with the intended purpose the installation with hinging symmetry on the receptacles 11 and 12 can take place either on the left-side end face 8*a* or on the right-side end face 8*b*. In particular, this installation with hinging symmetry, which is to be understood relative to the center axis M of the household appliance 1, is also achieved if the receptacles 11, 12 are arranged in the manner already described with regard to FIG. 1. The same then also applies in particular for the receptacles 13, 14.

As is furthermore apparent in FIG. 8, the bearing pin 23, when viewed in the width direction, is smaller than the distance measured in this width direction between the holes 20 and 21. This means that, in this front-side view and in particular also in the projection view, the holes 20 and 21 are arranged in their entirety adjacent to the bearing pin 23 in one exemplary embodiment. When viewed in the depth direction (z direction), the guiding of screws 32 and 33 past the bearing pin 23 can thus be enabled in a problem-free manner and said screws can then be inserted into the holes 20 and 21. Furthermore, this geometrical embodiment also enables assembly to be carried out in a problem-free manner by means of a tool, for example a screwdriver, past this bearing pin in the depth direction in order to then screw in the screws.

A width dimension of the bearing pin 23 measured in the width direction is thus smaller than a distance measured in the width direction between the hole axes M2 and M3, in particular smaller than the distance between the holes 20 and 21, which is measured between the hole edges facing toward one another.

Figure 9:
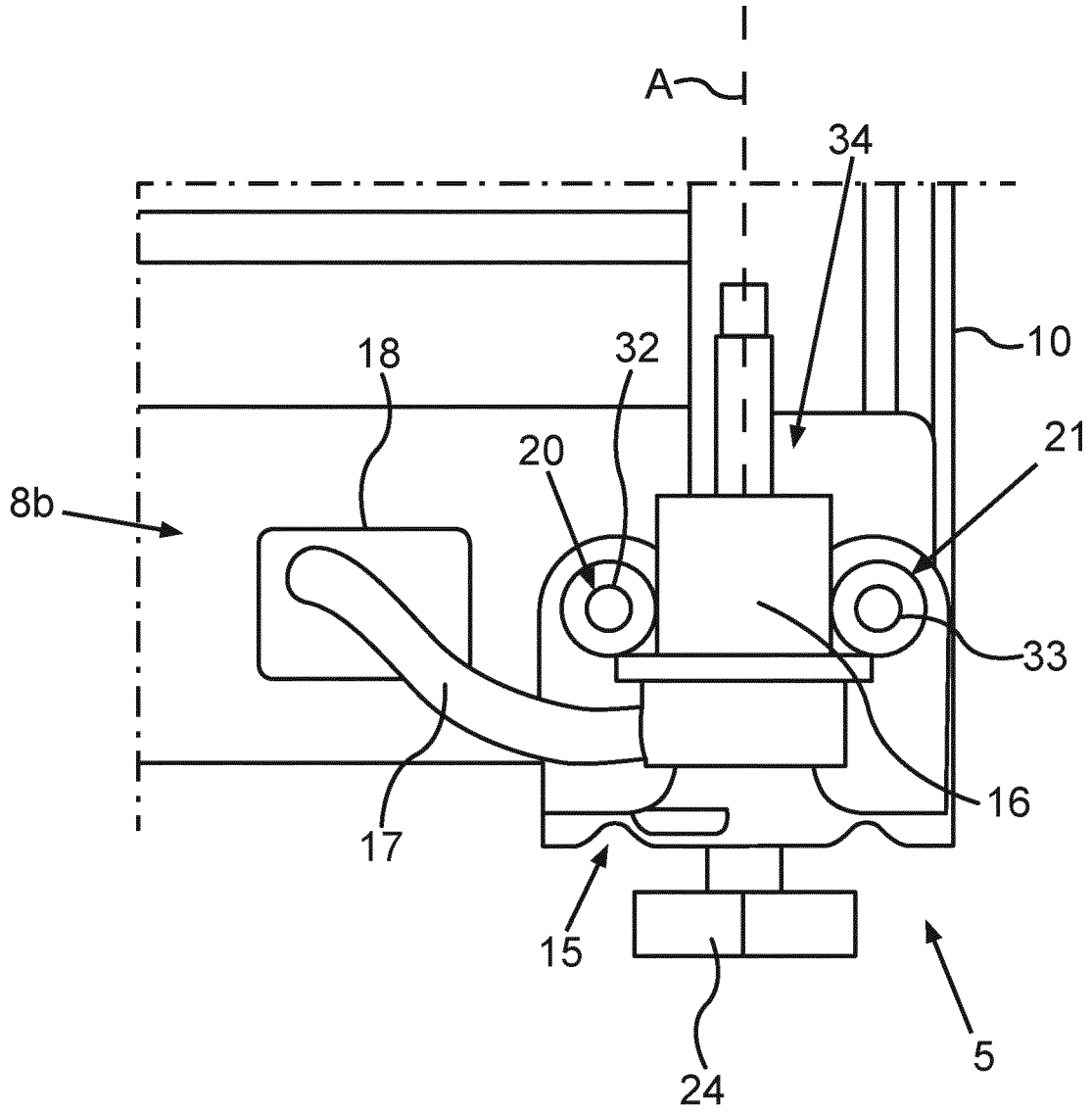
FIG. 9 shows a front view of the representation according to FIG. 3.

FIG. 9 shows a front view onto the partial region in accordance with FIG. 3 and FIG. 4, wherein the installed state of the hinge 5 on the housing 2, in particular on the front 6, is shown here. The symmetrical position is apparent here. In particular, it is generally also provided that the bearing bracket 15 defines the axis of rotation A of the door 4, wherein this axis of rotation A is arranged centrally between the holes 20 and 21 when viewed in the width direction in a projection view as described with regard to FIG. 8. The projection plane can thus lie in the contact plate 19, in particular in the exemplary embodiments already described.

Screws 32 and 33 are shown. These screws 32 and 33 are guided through the holes 20 and 21 and screwed directly in the receptacles 12, 11.

As already indicated above, the hinge 5 has a cable guiding apparatus 34. The cable guiding apparatus 34 is embodied in accordance with the intended purpose to guide at least one cable 17 between the door 4 and the housing 2 in the hinge 5.

Figure 10:
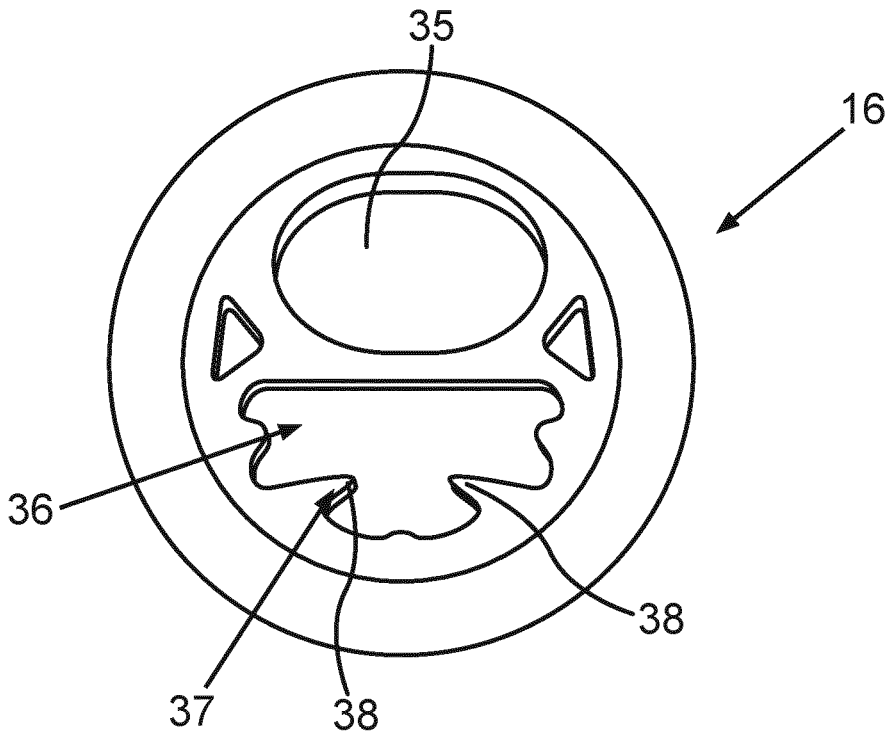
FIG. 10 shows a representation of an exemplary embodiment of a bushing of the hinge.

In particular, the cable guiding apparatus 34 has a cable passage 35 in the bushing 16, as shown in FIG. 10. In this context, FIG. 10 shows the bushing 16 with a view in the direction of the bushing axis, which runs parallel to the axis of rotation A in the assembled state. The bushing 16 thus has this cable passage 35. This cable passage 35 is in particular a cable channel.

The bushing 16 also has an insertion channel 36. The insertion channel 36 is separated from the cable passage 35. The insertion channel 36 is embodied in accordance with the intended purpose to be fitted onto the bearing pin 23. The bearing pin 23 is thus provided to be introduced into the insertion channel 36.

The insertion channel 36 has an inner contour 37. The inner contour 37 has a clamping structure 38. The clamping structure 38 has two clamping pins in the exemplary embodiment. With the clamping structure 38, a holding of the bearing pin 23 in a clamping manner in this insertion channel 36 is achieved in accordance with the intended purpose. The bushing 16, when viewed in the circumferential direction about the axis of rotation A, is coupled mechanically to the bearing pin 23 in a torsion-resistant manner. As is apparent in FIG. 10, the cable passage 35 and the insertion channel 36 are thus two separate channels.

Figure 11:
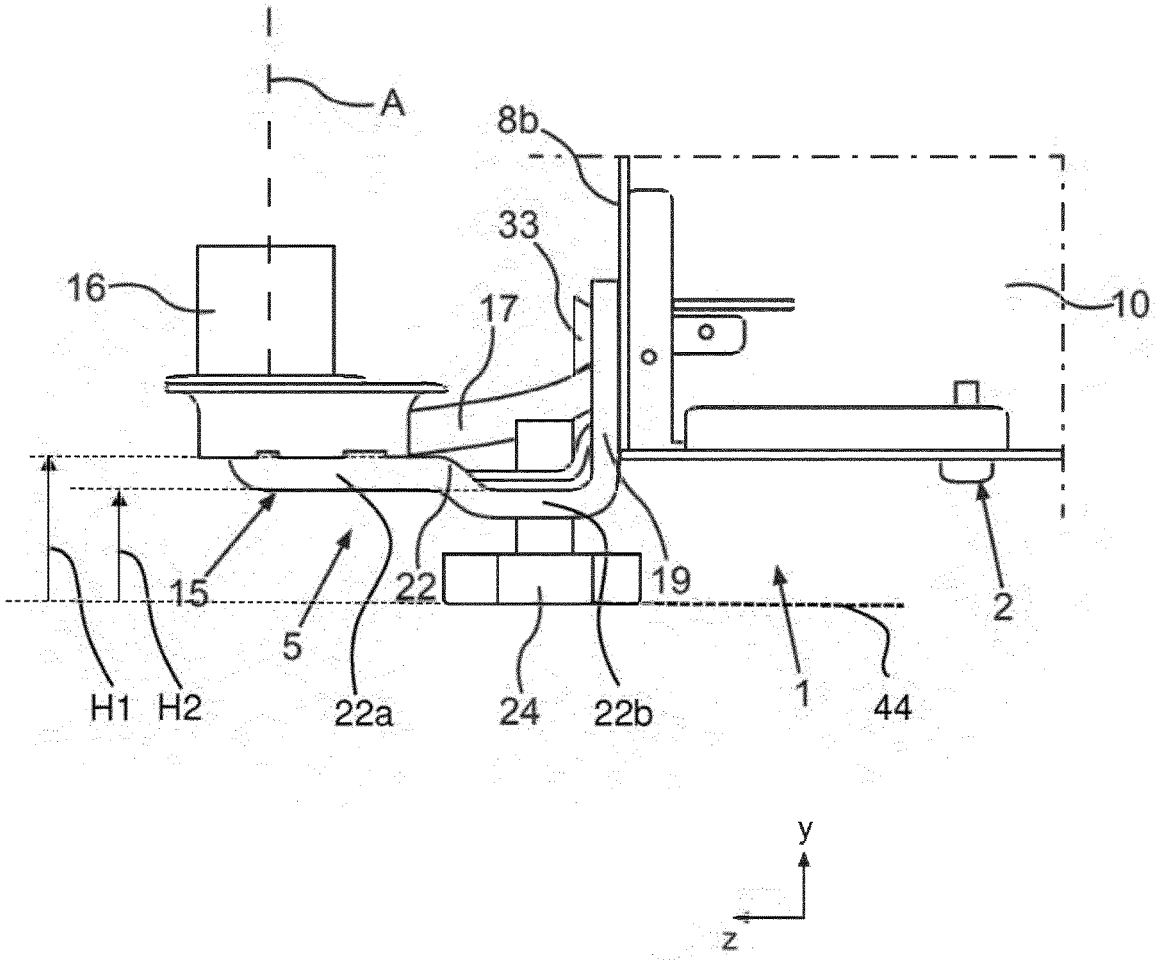
FIG. 11 shows a side view of a partial section of the exemplary embodiment of a household appliance in the region of the assembled hinge.

FIG. 11 shows a side view onto a lower subregion of the household appliance 1. In particular, a side view onto the arrangement in accordance with FIG. 3 is shown. As is apparent here, the entire hinge 5, in particular the entire bearing bracket 15, thus extends in front of the front 6 and thus also in front of the end face 8*b*, as is shown here. The bearing bracket 15 is fastened, in particular screwed, only on this end face 8*b*. Starting from this end face 8*b*, it extends forward in the depth direction.

Furthermore, it is also apparent that the freestanding foot 24 is directly arranged not on the housing 2, but instead exclusively and only on the hinge 5, in particular the bearing bracket 15.

The freestanding foot 24 can be supported on an installation base 44, for example a kitchen floor.

The coupling plate 22 has a first section 22*a* and a second section 22*b* arranged offset thereto in the height direction y. The first section 22*a* lies at a first height level H1. The second section 22*b* lies at a second height level H2. The height level H1 is greater than the height level H2. The height levels H1, H2 are measured in each case by the upper surface of the essentially planar sections 22*a*, 22*b*. The bearing pin 23 is molded on adjacent to the first section 22*a*. The threaded hole for receiving the freestanding foot 24 is embodied in the second section 22*b*. In the representation according to FIG. 11, the freestanding foot 24 is not screwed into the bearing bracket 15 as far as it will go. If however the freestanding foot 24 is screwed in further until it abuts against the bearing bracket 15, the lower-lying second section 22*b* can prevent the freestanding foot 24 from colliding with a lower edge (of the door, which is not shown).

Figure 12:
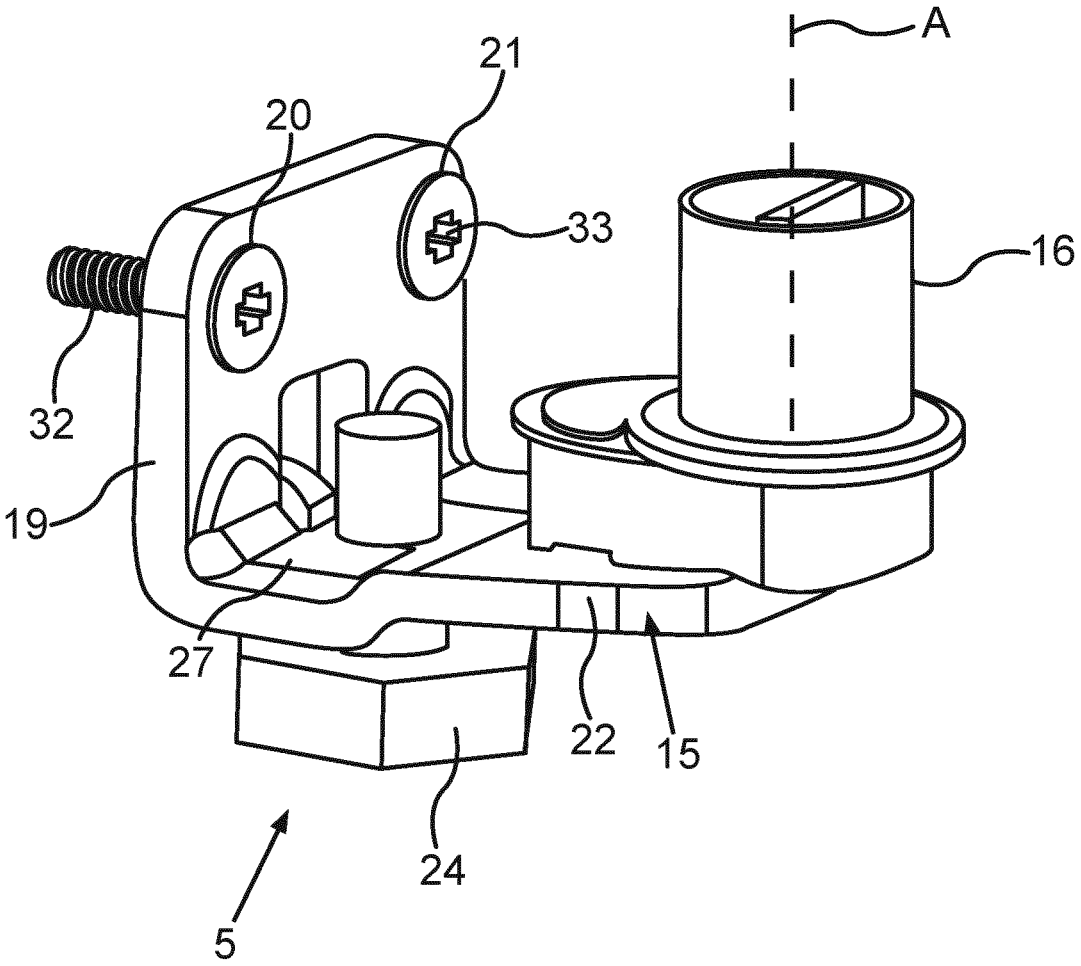
FIG. 12 shows a perspective representation of an exemplary embodiment of an assembled hinge.

FIG. 12 once again shows a perspective representation of the hinge 5 with the freestanding foot 24, as described previously.

Figure 13:
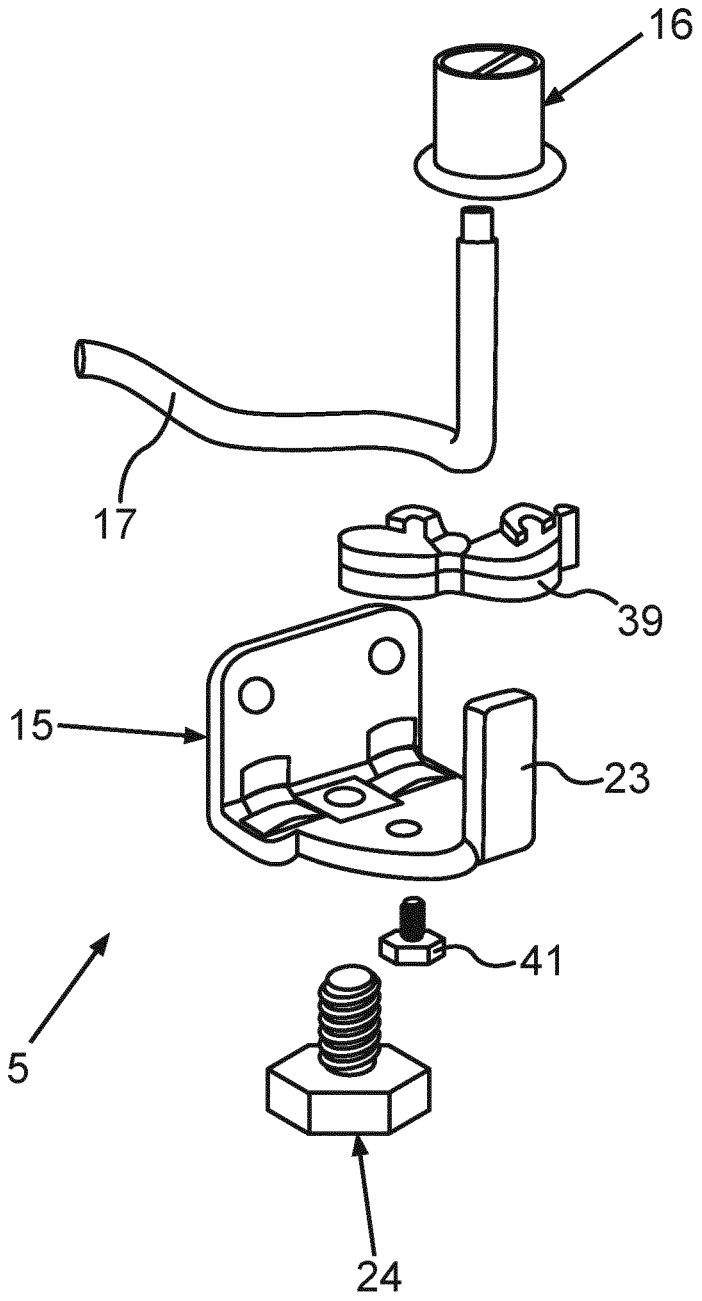
FIG. 13 shows an exploded view of a further exemplary embodiment of a hinge of a household appliance according to the invention.

FIG. 13 shows an exploded representation of a further exemplary embodiment of a hinge 5. This differs from the exemplary embodiments previously described in that, with this hinge 5, the bushing 16 is embodied smaller when viewed in the height direction. Furthermore, in this exemplary embodiment of the hinge 5, an additional adapter part 39 is provided. The adapter part 39 is separate from the bushing 16 and separate from the bearing bracket 5. This exemplary embodiment of the hinge 5 is embodied with a closing function. In contrast thereto, the exemplary embodiment in accordance with FIGS. 3, 4, 5, 9, 11 and 12 is embodied without such a closing function.

Figure 15:
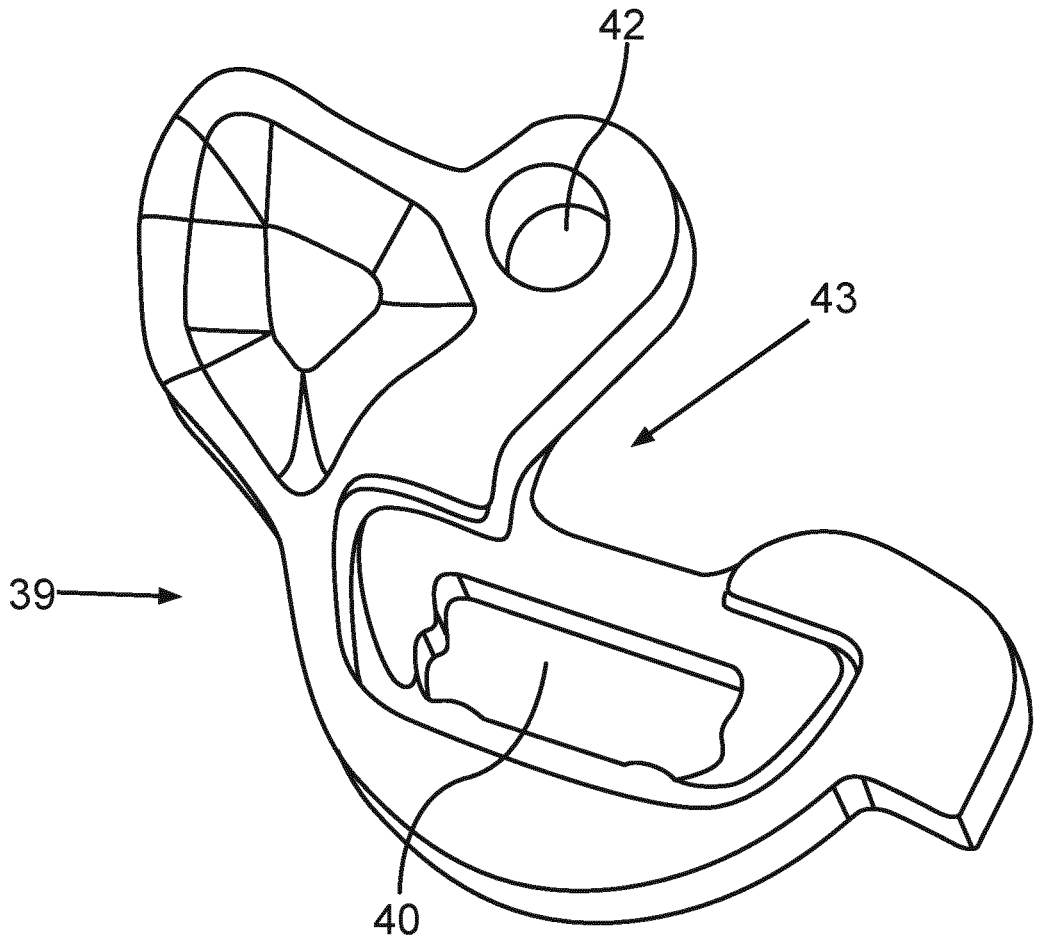
FIG. 15 shows a perspective representation of an adapter part of the hinge according to FIG. 13.

The adapter part 39 has an insertion channel 40, as is shown in the perspective representation in FIG. 15. This insertion channel 40 is provided in accordance with the intended purpose such that the bearing pin 23 engages or extends therethrough. In particular, here too, the insertion channel 40 is embodied such that a holding in a clamping manner is realized between the adapter part 39 and the bearing pin 23. The adapter part 39, too, is arranged in a torsion-resistant manner on the bearing bracket 15. In particular, it is arranged in a torsion-resistant manner on the bearing pin 23.

As already explained with regard to FIGS. 6 and 7, the bearing bracket 15 can have the screw holes 28 and 29. Depending on the installation position of the adapter part 39 on the bearing bracket 15, this adapter part 39 can be screwed thereto with a screw 41 (FIG. 13). This screw 41 is guided through a hole 42 in the adapter part 39.

In this exemplary embodiment, it can also be provided that the adapter part 23 has a notch 43 which is open on the edge side. This is provided in accordance with the intended purpose such that the cable 17 can be laid therethrough. In this exemplary embodiment, however, it is then not necessary for the cable 17 to be guided or inserted through an explicit hole which is circumferentially bordered or closed.

The adapter part 39 can also be installed in a reversed manner on the bearing bracket 15. Starting from the position shown in FIG. 15, it can be fitted onto the bearing pin 23 and the hole 42 arranged flush with the hole 29, and then a corresponding screw connection embodied. It is however possible for the adapter part 39, starting from the representation in FIG. 15, to be rotated by 180° such that the bearing pin 23 is then inserted through the insertion channel 40 and the hole 42 is arranged flush with the hole 29. In this regard, too, a corresponding screw connection can then be established.

Figure 14:
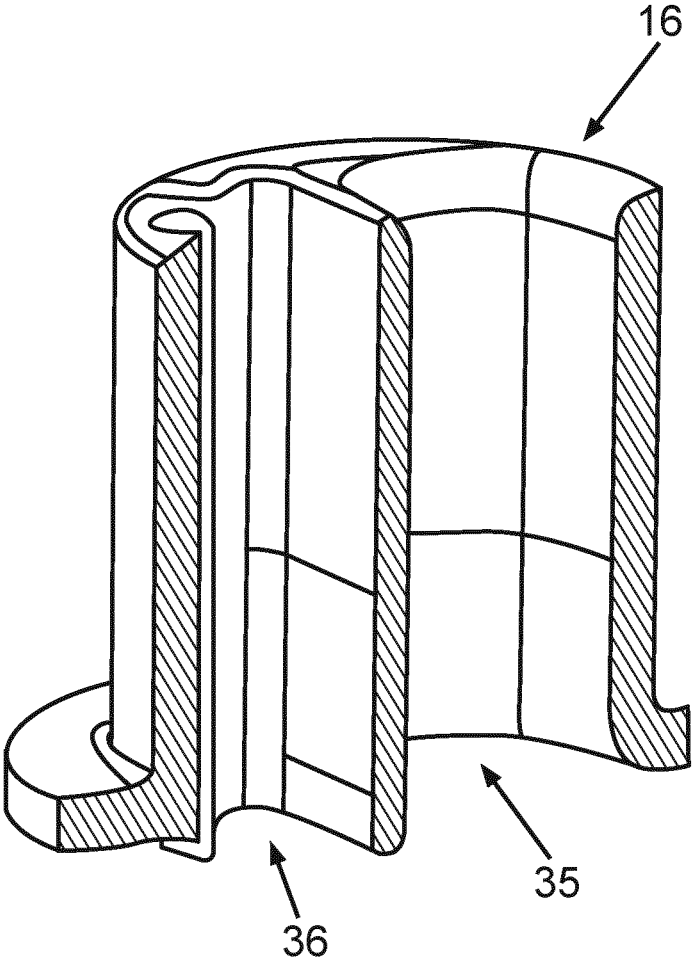
FIG. 14 shows a perspective sectional representation of an exemplary embodiment of a bushing of the hinge according to FIG. 13.

FIG. 14 shows a perspective sectional representation of the bushing 16. It is apparent that an upper edge and/or a lower edge of the cable passage 35 are rounded. Damage to the cable guided therethrough is thus avoided.

LIST OF REFERENCE CHARACTERS

1 Household appliance
2 Housing
3 Receiving compartment
4 Door
5 Hinge
6 Front
7 Hinge
8 End face
8*a* Left-side end face
8*b* Right-side end face
9 End
10 End
11 Receptacle
12 Receptacle
13 Receptacle
14 Receptacle
15 Bearing bracket
16 Bushing
17 Cable
18 Opening
19 Contact plate
20 Hole
21 Hole
22 Coupling plate
23 Bearing pin
23*a* Defining edge
24 Freestanding foot
25 Screw receptacle
26 Threaded pin
27 Embossed area
28 Screw hole
29 Screw hole
30 Positioning element
31 Positioning element
32 Screw
33 Screw
34 Cable guiding apparatus
35 Cable passage
36 Insertion channel
37 Inner contour
38 Clamping structure
39 Adapter part
40 Insertion channel
41 Screw
42 Hole
43 Notch
44 Installation base
A Axis
M Central axis
M1 Axis of symmetry
M2 Central axis
M3 Central axis
a1 Distance
a2 Distance
a3 Distance
H1 First height level
H2 Second height level
x Width direction
y Height direction
z Depth direction

The invention claimed is:

1. A household appliance, comprising:

a housing having a front with an end face, said housing having at least one receiving compartment disposed in said housing for receiving food;

at least one hinge disposed on said front of said housing;

a door disposed on said at least one hinge, permitting said door to be pivoted relative to said housing;

said at least one hinge having a bearing bracket and at least one fastening element fastening said bearing bracket to said end face;

said bearing bracket having a symmetrical construction as viewed from said front of the household appliance, and said bearing bracket having an integrated bearing pin;

said at least one hinge having a separate bushing with an insertion channel into which said integrated bearing pin engages, said at least one hinge having a cable guiding apparatus laying or configured to lay at least one cable between said door and said housing in accordance with an intended purpose;

said separate bushing being a component of said cable guiding apparatus and also having a cable passage or a cable channel for said at least one cable; and said insertion channel of said separate bushing for said integrated bearing pin being separated from said cable passage in said separate bushing.

2. The household appliance according to claim 1, wherein said bearing bracket is constructed symmetrically relative to an axis of symmetry oriented in a height direction of the household appliance.

3. The household appliance according to claim 1, wherein said bearing bracket has a contact plate resting directly on said end face, and said contact plate has at least two holes formed therein at a distance from one another in a width direction of the household appliance, permitting screws to be guided through said at least two holes as fastening elements.

4. The household appliance according to claim 3, wherein said bearing pin is disposed offset forward relative to said contact plate as viewed in a depth direction of the household appliance, said bearing pin being disposed centrally in a projection into a plane of said contact plate as viewed in said width direction.

5. The household appliance according to claim 4, wherein said bearing pin is disposed centrally between said at least two holes in the projection into the plane of said contact plate as viewed in said width direction.

6. The household appliance according to claim 5, wherein said bearing pin is smaller, as viewed in said width direction, than a smallest distance measured in said width direction between said at least two holes.

7. The household appliance according to claim 1, wherein said at least one hinge has an adapter part being separate from said separate bushing and being disposed in a torsion-resistant manner on said integrated bearing pin of said bearing bracket, and said separate bushing sitting on top of said adapter part.

8. The household appliance according to claim 1, wherein said bearing bracket has a horizontally oriented coupling plate, and a freestanding foot for the household appliance is directly disposed on said coupling plate.

9. The household appliance according to claim 8, wherein said coupling plate has a first section at a first height level and a second section at a second height level being different than said first height level.

10. The household appliance according to claim 9, wherein said first height level is greater than said second height level, said bearing pin is adjacent to said first section, and said second section has a threaded hole formed therein receiving said freestanding foot.

* * * * *